US006928703B2

(12) United States Patent
Petravic et al.

(10) Patent No.: US 6,928,703 B2
(45) Date of Patent: Aug. 16, 2005

(54) SEALED SLIDER ADJUSTMENT MECHANISM

(76) Inventors: Robin Petravic, 2700 18th St., San Francisco, CA (US) 94110; Catherine Bailey, 9 Marie St., Sausalito, CA (US) 94965

( * ) Notice: Subject to any disclaimer, the term of this patent is extended or adjusted under 35 U.S.C. 154(b) by 0 days.

(21) Appl. No.: 10/334,265

(22) Filed: Dec. 31, 2002

(65) Prior Publication Data

US 2003/0177616 A1 Sep. 25, 2003

Related U.S. Application Data

(60) Provisional application No. 60/407,937, filed on Sep. 5, 2002, and provisional application No. 60/366,553, filed on Mar. 25, 2002.

(51) Int. Cl.[7] ..... A44B 19/00

(52) U.S. Cl. ..... 24/68 R; 24/381; 24/418

(58) Field of Search ..... 24/381–383, 385, 24/68 R, 415, 418; 2/96, 195.4; 150/108

(56) References Cited

U.S. PATENT DOCUMENTS

| | | | | |
|---|---|---|---|---|
| 1,980,955 | A | * 11/1934 | Norton | 24/381 |
| 2,042,105 | A | 5/1936 | Kelley | |
| 2,351,803 | A | 6/1944 | Best | |
| 2,353,086 | A | 7/1944 | Schaaff | |
| 2,394,732 | A | 2/1946 | Williams et al. | |
| 2,825,139 | A | 3/1958 | Boehm | |
| 2,846,689 | A | 8/1958 | Engel | |
| 3,751,732 | A | 8/1973 | Mott | |
| 4,027,361 | A | 6/1977 | Yoneya | |
| 5,725,490 | A | 3/1998 | Conran | |
| 6,092,266 | A | 7/2000 | Lee | |
| 6,438,806 | B1 | 8/2002 | Lin | |
| 6,453,521 | B1 | 9/2002 | Dischler | |
| 6,481,890 | B1 | 11/2002 | VandenHeuvel | |

FOREIGN PATENT DOCUMENTS

| | | |
|---|---|---|
| FR | 2550066 A1 | 2/1985 |

* cited by examiner

*Primary Examiner*—James R. Brittain
(74) *Attorney, Agent, or Firm*—GSS Law Group; Gregory Scott Smith

(57) ABSTRACT

An adjustment mechanism including a slide positioned between two zipper tapes, an underlayer positioned adjacent the zipper tapes and the slide, and an adjustment control element coupled to the inner portion of the slider and positioned between the zipper tapes and the underlayer and also coupled to a feature of an item to be adjusted.

19 Claims, 8 Drawing Sheets fig.5a
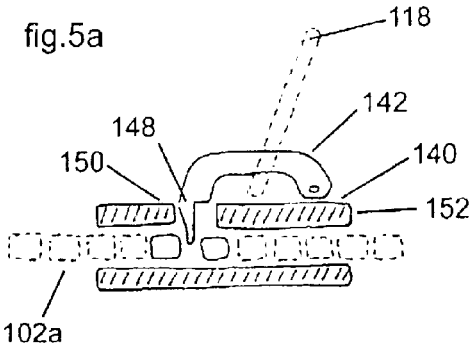
fig.5b
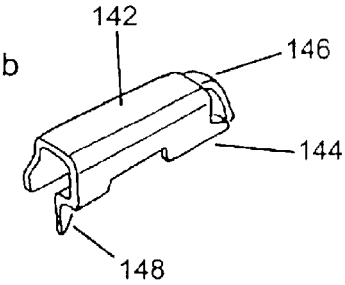
fig.5c
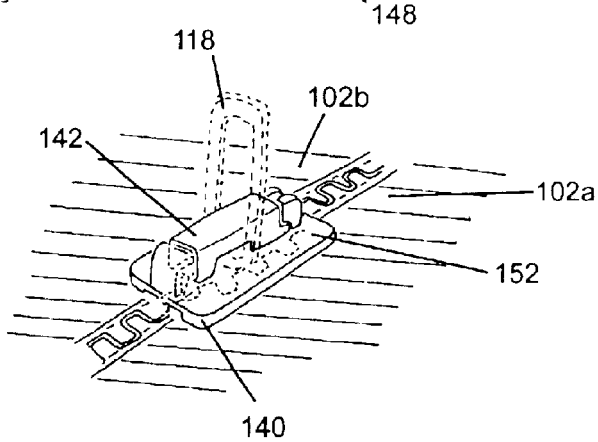
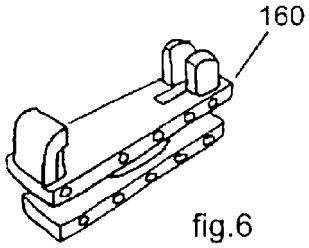
fig.6
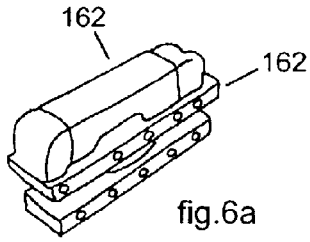
fig.6a
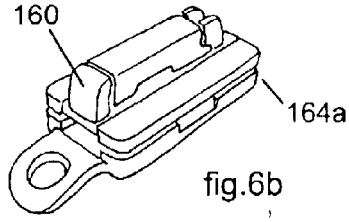
fig.6b
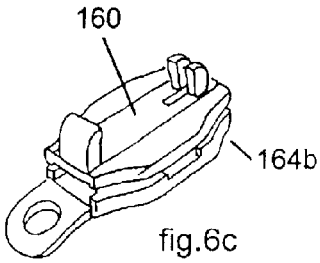
fig.6c
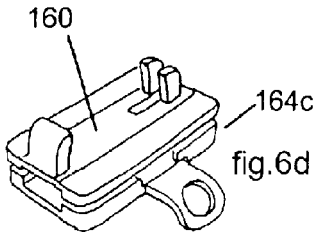
fig.6d
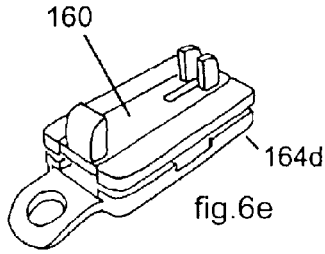
fig.6e

SEALED SLIDER ADJUSTMENT MECHANISM

CROSS REFERENCE TO RELATED PATENTS

This application claims benefit of U.S. provisional patent application Ser. No. 60/366,553 filed Mar. 25, 2002, and U.S. provisional patent application Ser. No. 60/407,937 filed Sep. 5, 2002, the specifications and drawings of which are both hereby incorporated by reference in their entirety.

I. BACKGROUND OF THE INVENTION

1. Field of the Invention

The present invention pertains generally to a method and mechanism for adjusting goods including but not limited to adjustable features of clothing, luggage, bags, and outdoor and sports equipment.

2. Background of the Invention

Many kinds of clothing, luggage, bags, outdoor and sports equipment include adjustment mechanisms for adjusting the article to fit an individual or to otherwise increase ease of use and comfort. Many kinds of adjustment mechanisms are known, including straps, draw strings, cords, and others. Often, the adjustment mechanisms are used to shorten or lengthen, tighten or loosen, some element of the article.

Generally, these adjustment mechanisms are visible on the outside of the article as they must be accessible to be used. There are many disadvantages to preexisting adjustment mechanisms. For example, straps, draw strings, cords may inadvertently come loose or catch on other items, and exposure of the adjustment mechanisms to wear can weaken the adjustment mechanisms causing tearing or breaking. There is a desire in the industry and among consumers to cover or hide the adjustment mechanisms to achieve a cleaner look, to prevent wear on the adjustment mechanisms, and to prevent the adjustment mechanisms from catching on other items.

What is needed is an adjustment mechanism that provides one or more of the following beneficial features: an outer surface that is free from loose hanging adjustment elements or features such as straps, draw strings, and cords; an adjustment mechanism wherein the adjustment mechanism features such as straps, draw strings, and cords are covered; an adjustment mechanism that does not include or require excess strap, draw string, and cord lengths; an adjustment mechanism that may be operated with one hand; an adjustment mechanism that uses the same or similar motion for both loosening and tightening or lengthening and shortening; an adjustment mechanism that includes discrete adjustment positions; an adjustment mechanism that does not have open entries for straps and cords; an adjustment mechanism that allows adjustment motion to follow a curve; an adjustment mechanism that allows adjustment without deforming the outer surface silhouette of the article; an adjustment mechanism wherein tension applied roughly perpendicular to the axis of motion of the adjustment mechanism doesn't affect the function of the adjustment mechanism; and an adjustment mechanism in which the adjustment element accessed by the user is separate from the strap, draw string, cord, or other adjustment feature; an adjustment mechanism whereby the adjustment elements can be sealed from the outside in a water resistant manner.

II. SUMMARY OF THE INVENTION

One aspect of the invention comprises an adjustment mechanism for adjusting a characteristic of an item or article such as clothing, luggage, bags, outdoor equipment, sports equipment, and other items generally referenced as soft goods, in order to increase ease of use and comfort.

The adjustment mechanism includes a slider or slide body that moves between a zipper including two zipper tapes, in some embodiments, by opening the zipper tapes at the leading edge of the slider and closing the zipper tapes at the trailing edge of the slider. The zipper tapes include some known means for releasably coupling as described, such as a row of coupling elements or teeth. The slider may include a pull element such as a pull tab. The slider may also include a locking mechanism to hold the slider in position until the user desires to move the slider.

The slider also includes at least one control element attachment point on the underside of the slider. In some embodiments, a control element is coupled to the control element attachment point. In other embodiments, more than one control element may be attached to the slider, and in other embodiments one or more control elements may be attached to the slider at more than one location or attachment point. In still other embodiments, the control element is contacted by the slider attachment point only when the slider is moved between the zipper tapes into contact with the control element.

In some embodiments, The control element extends between the slider and an item attachment point on the adjustable item that includes the adjustment mechanism of the invention. Virtually any number of control elements may be used to control any number of adjustable features on the item. Some embodiments further comprise an underlayer positioned with the control element between the underlayer and the zipper. In other embodiments, the item further includes tunnels or channels formed in the item, with the control element extending between the slider and the adjustment point on the item. The path traveled by the control element may include turns, and this may be accomplished in a number of ways including the use of turn posts formed in the adjustable item.

Many kinds of adjustable features may be adjusted using the adjustment mechanism of the invention including but not limited to lengths of portions of an item and the circumference of openings of an item. Adjustable items may include, but are not limited to, jackets hats, pants, shoes, mittens, and bags.

III. BRIEF DESCRIPTION OF THE DRAWINGS

FIG. 5*a* shows an embodiment of the locking arm of a locking slider

FIG. 5*b* shows a perspective view of the locking slider assembled onto a pair of zipper strips FIG. 5*c* shows a side cutaway view of a locking slider.

FIG. 6 shows an embodiment of a basic slider chassis on which other components may be molded FIG. 6*a* shows an example slider body embodiment co-molded onto the base chassis of FIG. 6

FIG. 6*b* shows another example slider body embodiment co-molded onto the base chassis of FIG. 6

FIG. 6*c* shows an additional example slider body embodiment co-molded onto the base, chassis of FIG. 6.

FIG. 6*d* shows another example slider body embodiment co-molded onto the base chassis of FIG. 6.

FIG. 6*e* shows an additional example slider body embodiment co-molded onto the base chassis of FIG. 6.

Figure 7:
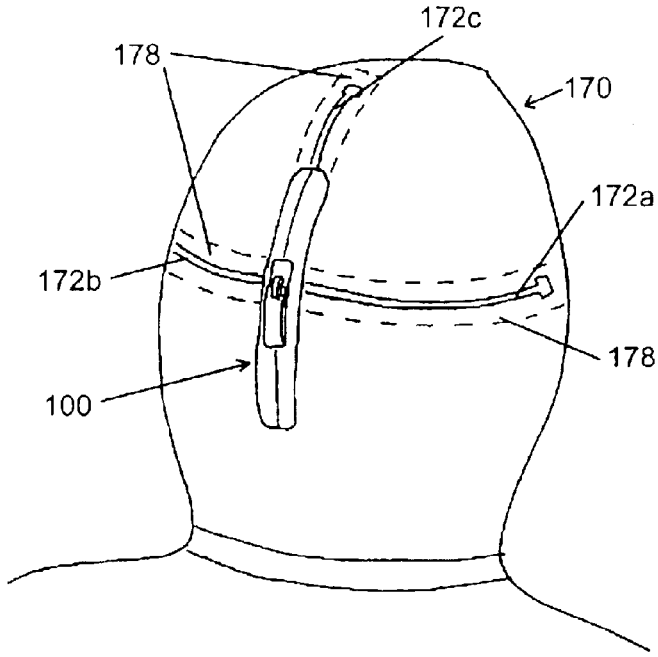

FIG. 7 shows a rear perspective view of an embodiment of the adjustment mechanism of the invention used on a jacket hood.

Figure 8:
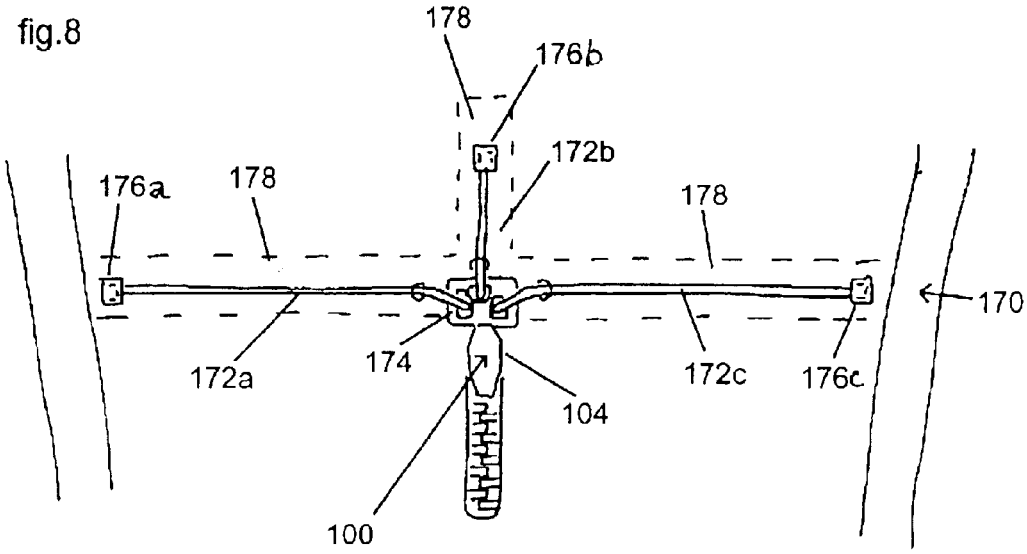

FIG. 8 shows an interior back view of the jacket hood of FIG. 7.

Figure 9:
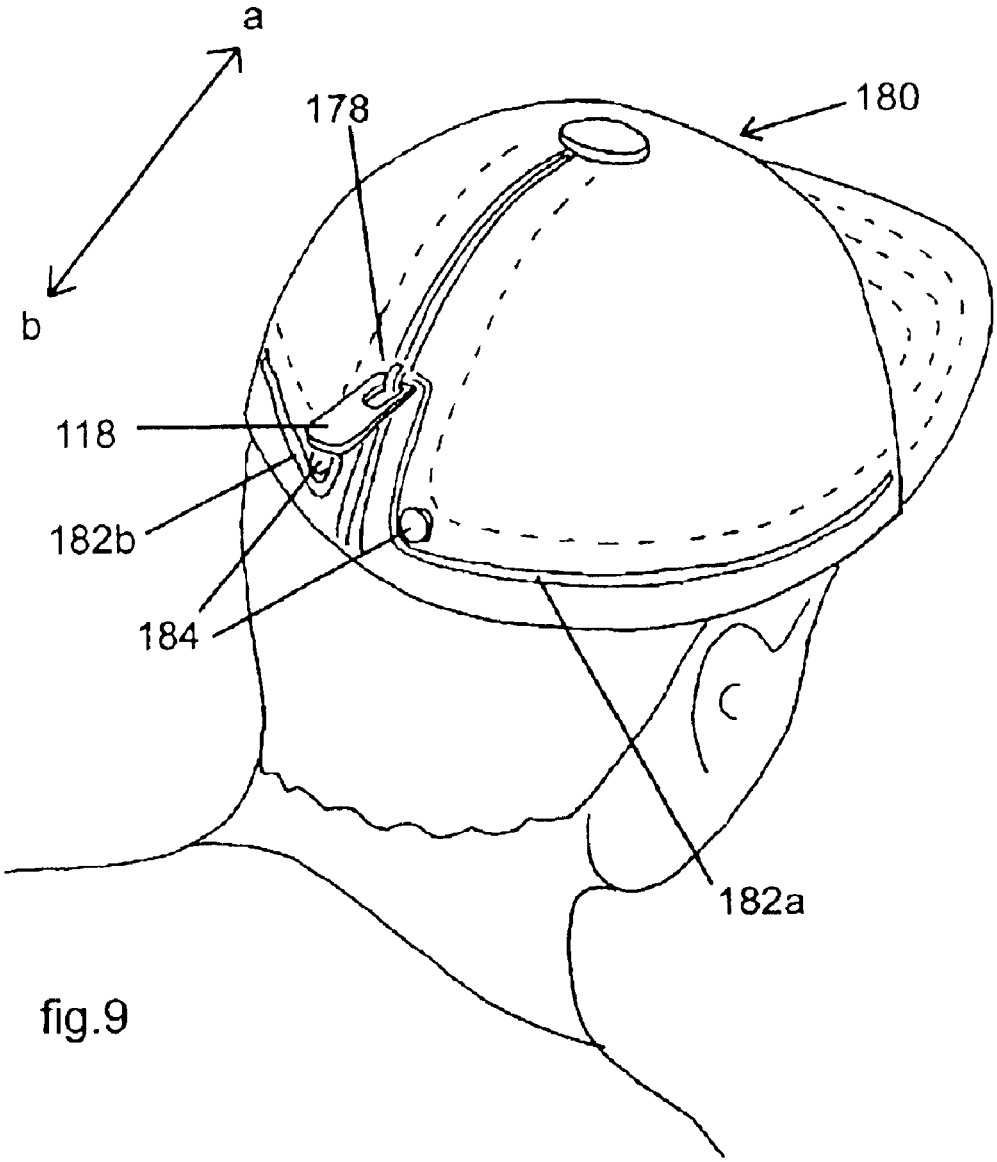

FIG. 9 shows an example of a hat including an embodiment of the adjustment mechanism of the invention.

Figure 10A:
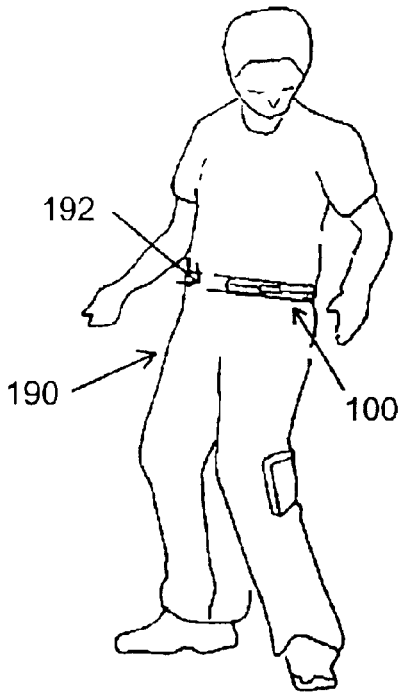

FIG. 10*a* shows an example of a pair of pants including an embodiment of the adjustment mechanism of the invention.

Figure 10B:
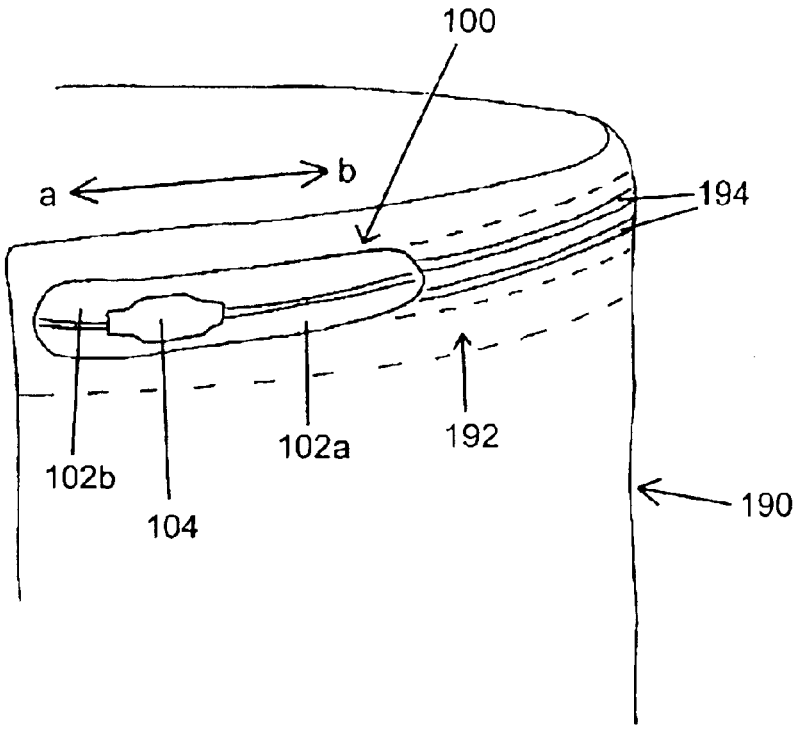

FIG. 10*b* shows a closer view of the adjustment mechanism of FIG. 10*a*.

Figure 11:
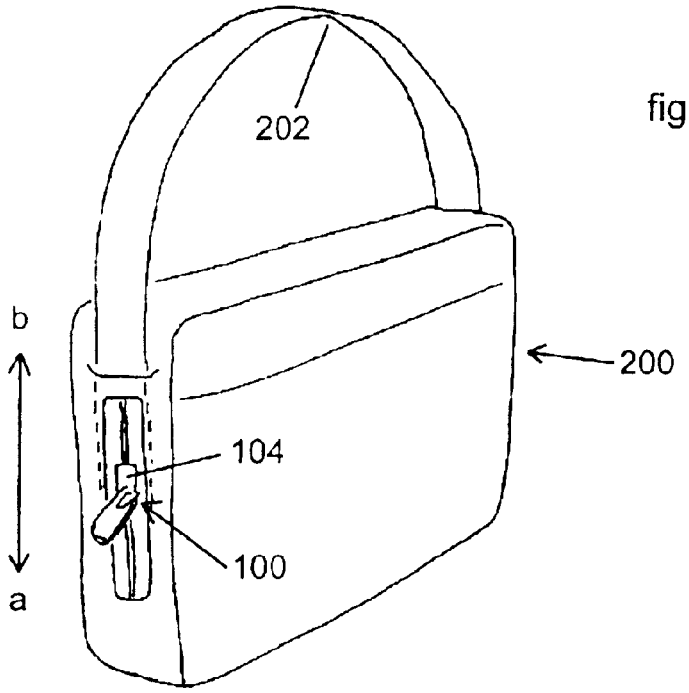

FIG. 11 shows an example bag including an embodiment of the adjustment mechanism of the invention.

Figure 12:
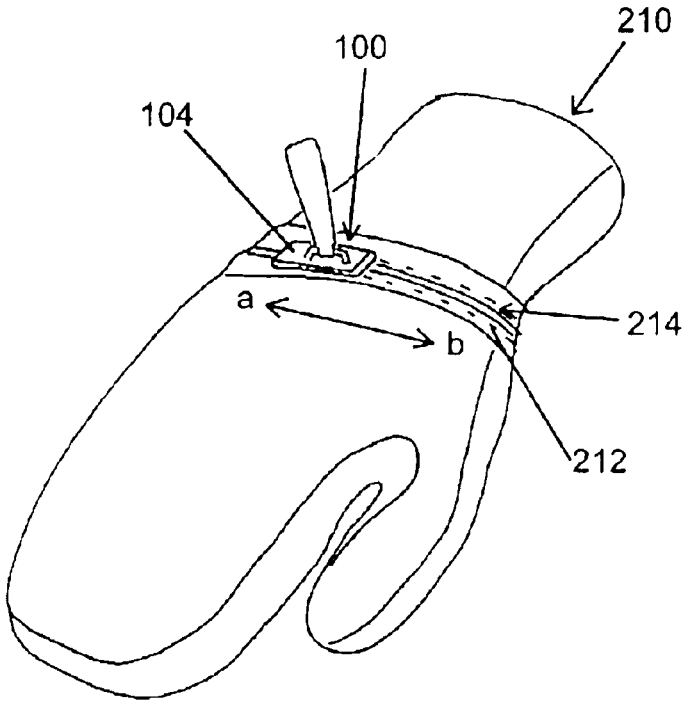

FIG. 12 shows an example mitten including an embodiment of the adjustment mechanism of the invention.

Figure 13:
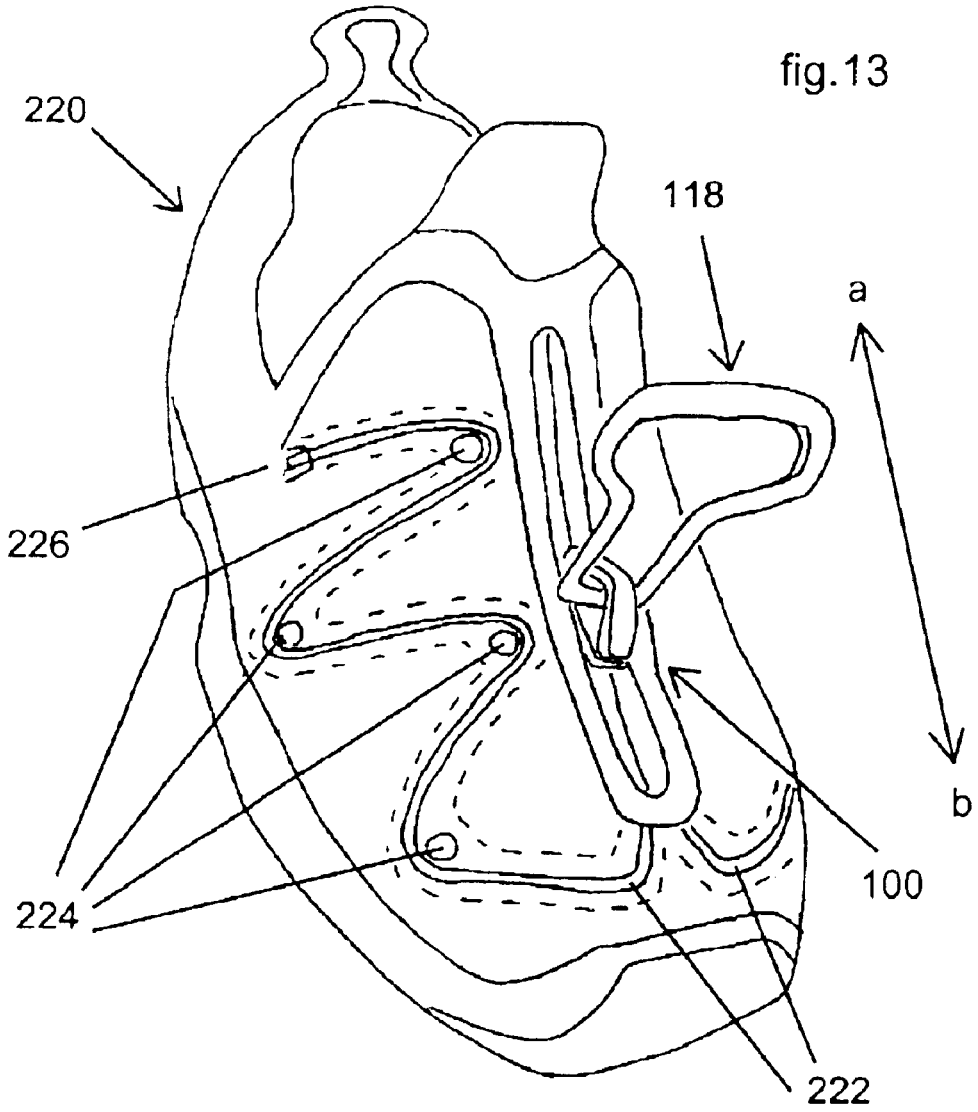

FIG. 13 shows an example shoe including an embodiment of the adjustment mechanism of the invention.

IV DETAILED DESCRIPTION OF THE INVENTION

Many kinds of items such as clothing, luggage, bags, outdoor equipment, sports equipment, and other items generally referenced as soft goods include adjustment mechanisms for adjusting the article to fit an individual or to otherwise increase ease of use and comfort. The invention disclosed herein includes both a method and mechanism, in accordance with the invention, for providing adjustability to goods such as those items described above.

Figure 1:
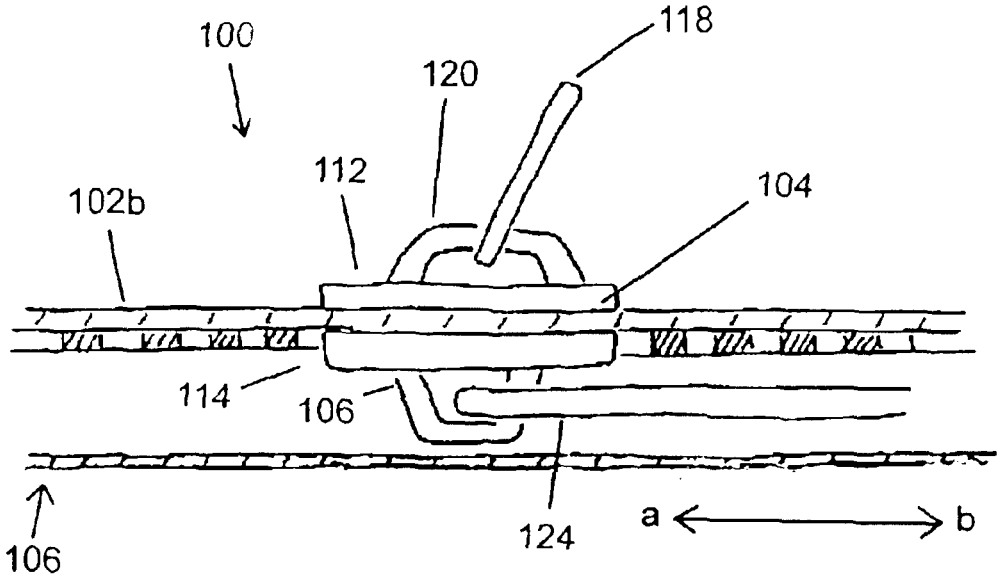
FIG. 1 shows a side view of an embodiment of an adjustment mechanisms according to the invention.

Referring to FIG. 1, one embodiment of the adjustment mechanism 100 includes a slider 104 positioned between two zipper tapes with the zipper tape 102*b* visible (zipper tape 102*a* is hidden behind zipper tape 102*b* in FIG. 1), an underlayer 106 positioned adjacent the zipper tapes 102*a* and 102*b* and the slider 104, and an adjustment control element (which is shown as cord 124 in the embodiment seen in FIG. 1) coupled to a portion of the slider 104 and positioned between the zipper tapes 102*a* and 102*b* and the underlayer 106. Sandwiching the adjustment control element 108 between the underlayer 106 and the zipper tapes 102*a* and 102*b* protects the control elements and provides a clean look to the item. However, the underlayer may not be required in all embodiments.

The zipper tapes 102*a* and 102*b* are preferably flexible with each zipper tape 102*a* and 102*b* including a linear row of coupling elements or teeth secured to an edge of the zipper tape 102*a* or 102*b* adjacent the other or opposing zipper tape so that the teeth of the zipper tapes 102*a* and 102*b* may interact to couple the zipper tapes 102*a* and 102*b* together. The zipper tapes 102*a* and 102*b* extend through two channels in the slider 104 as seen generally in the Figures. A coupling element or tooth as used herein generally refers to a series of features or projections arrayed along a strip and/or cord in a spaced fashion. The features or projections further include a geometry for mechanical interlocking with mating surface geometry of adjacent projections on the mating zipper tape. Many kinds of zipper tape and teeth are commercially available in many different configurations and may be made from many different materials. One skilled in the art can easily select acceptable zipper tape and teeth combinations for use in the invention.

Figure 2:
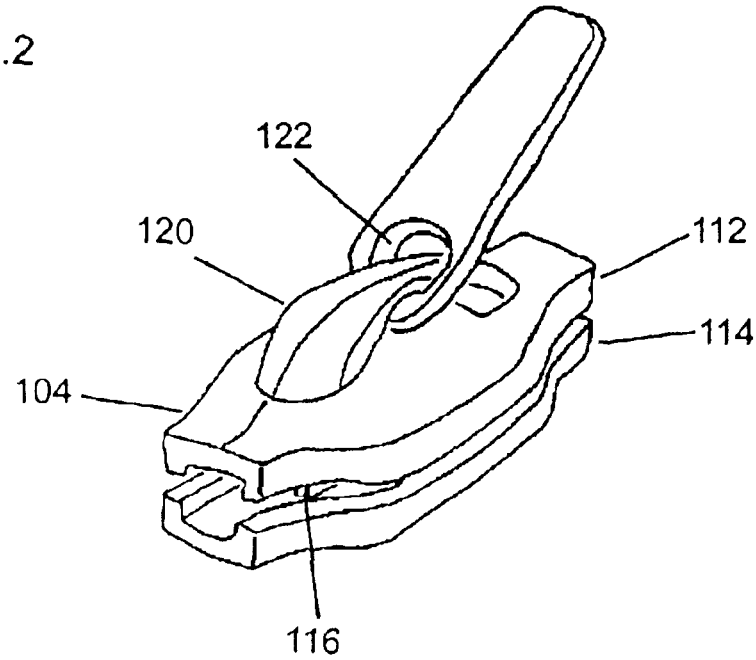
FIG. 2 shows a perspective view of the slider of the adjustment mechanisms FIG. 1.

FIG. 2 shows a perspective view of an embodiment of the slider 104 in isolation. The slider 104 is configured as a single body that is preferably symmetrical about a centerline of the body of slider 104. The slider 104 includes an upper plate 112, a lower plate 114, and a tape separation structure 116 attached between the upper plate 112 the and lower plate 114, and defining two channels 110*a* and 110*b* that extend from the front to the back of the slider 104. The body of the slider 104 may be made from a number of known and acceptable materials including various plastic and metal materials. Methods for manufacturing sliders are generally well known and include but are not limited to injection molding of plastic and/or metal, and die casting metal. In alternate embodiments the slider 104 may be asymmetrical. In still other embodiments, the slider 104 may comprise two separate sliders that are preferably hooked together, and preferably in opposite orientation.

One function of the slider 104 is to move between the two sealed zipper strips 102*a* and 102*b* with the leading edge of the slider 104 separating the zipper strips 102*a* and 102*b*, and the trailing edge closing the zipper strips 102*a* and 102*b* to maintain a seal around the slider 104 as the slider 104 is moved. Maintaining the seal around the slider 104 protects the other parts of the adjustment mechanism 100 and inhibits dirt and water from entering the item at the adjustment mechanism 100.

The slider 104 also includes architecture for coupling to a pull tab 118 or other feature for manipulating the slider 104. The Figures generally show an embodiment of the slider 104 including a single loop 120 on the upper plate 112 of the slider 104 for coupling to a pull tab 118. The pull tab 118 shown includes an aperture 122 in which the loop 120 is received, and may also include features intended to enhance the grip of the user when using the pull tab 118, such as a roughened texture on a portion of the tab 118. In alternate embodiments, other acceptable pull tab configurations may be used, and other known elements such as cords or the like may serve the same function.

The lower plate 114 of the slider 104 includes at least one slider attachment point for a control element 108. The term "control element" is used to mean any feature for adjusting a characteristic or shape of an item on which the adjustment mechanism 100 is used. The control element 108 may include, but is not limited to, a cord, cable, draw string, ribbon, or in some embodiments direct attachment to a portion of the item to be adjusted. In still other embodiments the slider attachment point may mover into and out of contact with the control element 108 as the slider 104 is moved. For example the slider attachment point may be a hook on the lower plate 114 of the slider 104 which grabs a cord to affect an adjustment only when the slider 104 is moved to contact the cord. In other embodiments, a single control element 108 may be coupled to the slider 104 at more than one slider attachment point, or alternatively, several control elements may be coupled to the slider 104. In further embodiments, a control element may be coupled to the item to be adjusted at more than one location.

Figure 4:
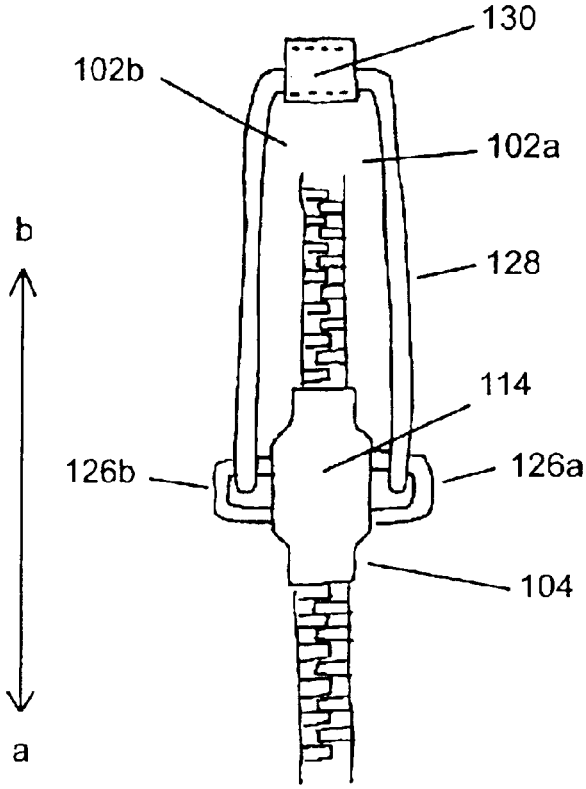
FIG. 4 shows a bottom view of an embodiment of the adjustment mechanism.

Two example embodiments are seen in FIGS. 1 and 4. FIG. 1 shows an embodiment of the slider 104 in which the attachment point for the adjustment control element 108 is a loop on the lower plate 114 of the slider 104, and in which the control element 108 is a cord 124. The end of the cord 124 opposite the end coupled to the slider 104 is preferably attached to a portion of the item to be adjusted. In use, the slider 104 is moved in direction A to shorten the adjustable feature of the item, and moved in direction B to lengthen the adjustable feature.

Figure 3:
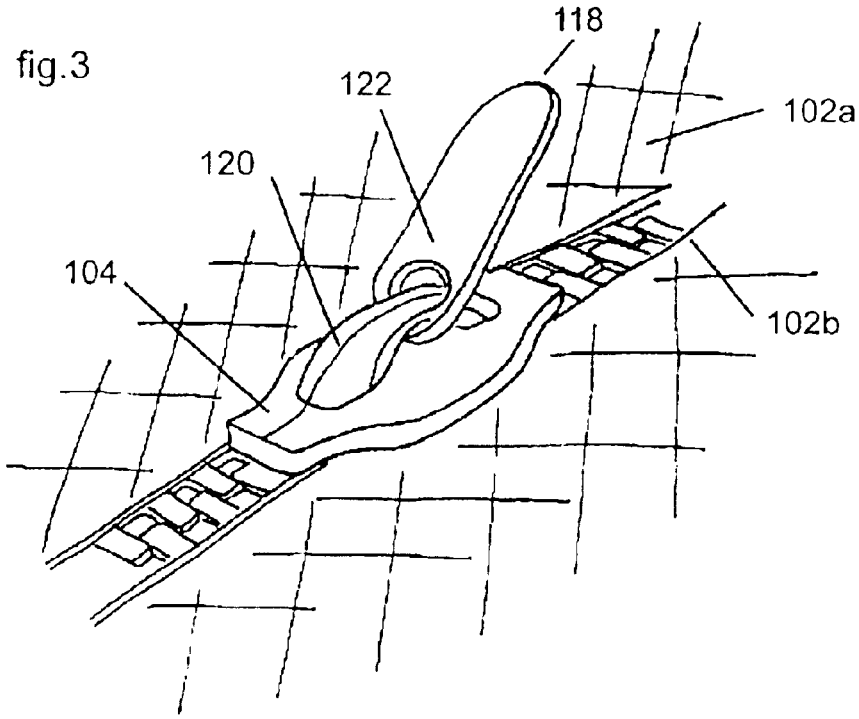
FIG. 3 shows a perspective view of the adjustment mechanisms of FIG. 1. On the surface of an item.

FIG. 3 shows a top perspective view of the adjustment mechanism 100, and illustrates how all of the parts of the adjustment mechanism 100 except the upper plate 112 and pull tab 118 of the slider 104 are hidden beneath the zipper straps 102*a* and 102*b*, which remain closed about the slider 104. In alternate embodiments, other known kinds of attachments at the attachment point 130 of the item may be used.

FIG. 4 shows a bottom view of an embodiment of the adjustment mechanism 100 including a slider 104 having two control element mounting features or loops 126 attached to single cord 128 coupled at each end to a loop 126 on the slider 104. The cord 128 extends to an item attachment point 130 on the fabric material of the item. In use, the slider 104 is moved in direction A to shorten the adjustable feature of the item, and moved in direction B to lengthen the adjustable feature. The slider 104 opens the zipper strips 102*a* and 102*b* at the leading edge of the slider 104, and closes the zipper strips 102*a* and 102*b* at the trailing edge of the slider 104.

In some embodiments the inherent resistance to movement of the slider 104 may be sufficient to hold the adjusted feature or characteristic of an item at a desired position. In other embodiments, a locking mechanism may be desired. Many zipper locking mechanism are known in the art, and one skilled in the art can easily select a useable locking mechanism. One example locking mechanism is seen in FIGS. 5*a*, 5*b*, and 5*c*. FIG. 5*a* shows a side cutaway view of an example locking slider 140. Referring to FIG. 5*b*, the locking mechanism includes a locking arm 142 including a hinge end 144, a locking tooth 148, and a spring portion 146 for urging the locking tooth 148 through an aperture 150 in the top plate 152 of the locking slider 140 and into a zipper strip 102*a* or 102*b* (as seen in FIG. 5*a*). FIG. 5*c* shows a perspective view of the locking slider 140 assembled onto the zipper strips 102*a* and 102*b*. When the tab 118 is pulled, the spring force of the spring portion 146 of the locking arm 142 is overcome, and the locking tooth 148 of the locking arm 142 is pulled from the zipper strip 102*a* or 102*b*. This allows free motion of the locking slider 140. When the user has adjusted the item by moving the locking slider 140 to the desired position, the tab 118 is released. Release of the tab 118 allows the spring force of the spring portion 146 of the locking arm 142 to urge the locking tooth 148 of the locking arm 142 into contact with the zipper strip 102*a* or 102*b*, inhibiting further movement of the locking slider 140.

In some embodiments, the slider 104 is a co-molded combination of metal and plastic. FIGS. 6 and 6*a* through 6*e* show several example co-molded embodiments. FIG. 6 shows an embodiment of a basic slider chassis 160 on which other components will be molded. The chassis 160 is preferably metal, but in alternate embodiments may be other materials including plastic. FIG. 6*a* shows the chassis with a co-molded loop of plastic material 162. FIGS. 6*b* through 6*e* show alternate slider body embodiments 164*a*, 164*b*, 164*c*, and 164*d*, co-molded onto the base chassis. Other configurations adapted for particular uses may be easily fabricated by one skilled in the art.

The adjustment mechanism 100 of the invention is useable on a large variety of items. Benefits of the invention may include one of more of the following: (1) an outer surface that is free from loose hanging adjustment elements or features such as straps, draw strings, and cords, (2) an adjustment mechanism wherein adjustment mechanism features such as straps, draw strings, and cords are inaccessible, (3) an adjustment mechanism that does not include or require excess strap, draw string, and cord lengths, (4) an adjustment mechanism that may be operated with one hand, (5) an adjustment mechanism that uses the same or similar motion for both loosening and tightening or lengthening and shortening, (6) an adjustment mechanism that includes discrete adjustment positions, (7) an adjustment mechanism that does not have open entries for straps and cords, (8) an adjustment mechanism that allows adjustment motion to follow a curve, (9) an adjustment mechanism that allows adjustment without deforming the outer surface silhouette of the article, (10) an adjustment mechanism wherein tension applied roughly perpendicular to an axis of motion of the adjustment mechanism doesn't affect the function of the adjustment mechanism, and (11) an adjustment mechanism whereby the adjustment elements can be sealed from the outside in a water resistant manner.

Examples of the invention in use on several example products will now be discussed. However, the adjustment mechanism 100 of the invention may be used on a wide variety of goods, and is not limited to the specific examples provided herein.

FIGS. 7 and 8 show an example embodiment of the adjustment mechanism 100 of the invention used on a hood 170 to allow adjustment of the volume of the hood 170 to fit varying size heads. FIG. 7 is a rear perspective view of the hood 170 showing adjustment cords 173*a*, 173*b*, and 173*c* running through cloth tunnels 178 to couple to adjustable features on the hood. The dotted lines indicated portions of the outer layer of the hood that have been removed to reveal the cords 173*a*–*c*. In some embodiments, the dotted lines may also indicate the dimensions of a cloth tunnel through which the cords 173*a*–*c* extend.

FIG. 8 shows an inside view of the hood 170. An interior layer lining of the hood 170 normally acting as the underlayer 106 is shown removed so that the adjustment mechanism 100 is visible. The slider 104 includes three control element mounting features 174*a*, 174*b*, and 174*c*. The adjustment cords 172*a*, 172*b*, and 172*c* interact with the slider 104 and the hood 170. Each adjustment cord 172*a*–*c* attaches to the hood 170 at drawstring end pieces 176*a*, 176*b*, and 176*c*. One end of each adjustment cords 172*a*–*c* is coupled to a to end piece 176*a*–*c* respectively. Moving the slider 104 in direction A causes the cords 172*a*–*c* to pull on draw cord end pieces 176*a*–*c* which are attached to adjustment locations on the hood, reducing the size of the hood. Moving the slider 104 in direction B relaxes the tension on adjustment cords 172*a*–*c*. Other adjustment configurations are usable in other embodiments.

FIG. 9 shows an example embodiment of the invention used on a baseball style hat 180. The slider 104 is coupled to two adjustment strings 182*a* and 182*b*. The dotted lines indicated portions of the outer layer of the hat that have been removed to reveal the adjustment strings 182*a* and 182*b*. In some embodiments, the dotted lines also indicate the dimensions of a cloth tunnel or channel through which the adjustment strings 182*a* and 182*b* extend. In the embodiment shown, the adjustment strings 182*a* and 182*b* extend through a channel in the hat 180 around two turn posts 183 and to the front of the hat 180. When the slider 104 of the adjustment mechanism 100 is moved in direction A, the tension on the adjustment strings increases, and the diameter of the hat 180 is decreased. Movement of the slider 104 of the adjustment mechanism 100 in direction B reduces the tension on the adjustment strings increasing the diameter of the hat 180.

FIGS. 10*a* and 10*b* shows an example embodiment of a pair of pants 190 including an adjustable waist 192. FIG. 10*a* shows the example pants 190 on a user. FIG. 10*b* shows a close up of the adjustment mechanism 100. Two adjustment cords 194 are shown positioned within a cloth tunnel in the waist 192 of the pants 190 under the outer surface of the waist 192 of the pants 190. The dotted lines indicated a portion of the outer layer of the waistband that has been removed to reveal the adjustment cords 194.

One end of each cord 194 is coupled to the underside of the slider 104. The other end of each cord 194 is coupled to the waist 192 of the pants 190, at a point not shown, some distance from the slider 104. When the slider 104 is moved in direction A, the length of the waist 192 is reduce, and when the slider 104 is moved in direction B the length of the waist 192 is increased. In alternate embodiments, a ribbon of material may be used instead of a pair of cords 194.

FIG. 11 shows an example shoulder bag 200 including the adjustment mechanism 100 of the invention. An adjustment mechanism 100 of the invention may be included on each side of the bag 200, however, only one adjustment mechanism 100 is shown. The slider 104 in this embodiment is coupled directly to the strap 202 of the shoulder bag 200, a portion of which is shown in hidden lines extending under the slider 104. Moving the slider 104 in direction A shortens the strap 202 of the handbag 200, and moving the slider 104 in direction B lengthens the strap 202 of the shoulder bag 200.

FIG. 12 shows an example mitten 210 using the adjustment mechanism 100 of the invention. Two adjustment cords 212 are—shown in hidden lines positioned within a cloth tunnel around the wrist 214 of the mitten 210. One end of each cord 212 is coupled to the underside of the slider 104. The other end of each cord 212 is coupled to the mitten 210, at a point, not shown, some distance from the slider 104. When the slider 104 is moved in direction A, the diameter of the wrist 214 is reduce, and when the slider 104 is moved in direction B the diameter of the wrist 214 is increased. In alternate embodiments, a ribbon of material may be used instead of a pair of cords.

FIG. 13 shows an embodiment of the adjustment mechanism 100 of the invention used on a shoe 220. The shoe may be tightened by moving the slider 104 which applies tension two adjustment cords 222 extending in a path around several turn posts 224 under the outer surface of the shoe as shown. The dotted lines indicated portions of the outer layers of the shoe that have been removed to reveal the adjustment cords 222. One end of each cord 222 is attached to the underside of the slider 104. The other end of each cord is coupled to the shoe at an end point 226. One end point 226 can be seen in FIG. 13. Moving the slider 104 in direction A increases the tension on the adjustment cords 222, thereby reducing the volume of the shoe 220. Moving the slider 104 in direction B reduces the tension applied to the cords 222.

What is claimed is:

1. An adjustment mechanism for adjusting an adjustable feature on an item, said adjustment mechanism comprising:

a slide body including a top plate and a bottom plate joined by a connection part defining a first channel and a second channel, said slide body further comprising a first connection point for connecting to a pull element, at least one connection point on said bottom plate for connecting to at least one control element, a zipper tape unit comprising a first zipper tape and a second zipper tape, said first zipper tape including a first edge for releasably coupling to a first edge of said second zipper tape, said first zipper tape extending through said first channel of said slide body, and said second zipper tape extending through said second channel of said slide body, and an underlayer positioned with said at least one control element in an enclosed channel between said underlayer and said zipper tape unit.

2. The adjustment mechanism of claim 1 wherein said slide body separates said first and second zipper tapes at a leading edge, and joins said zipper tapes at a trailing edge.

3. The adjustment mechanism of claim 1, wherein said first edge of said first zipper tape comprises a first row of coupling elements for releasably coupling to a second row of coupling elements on said first edge of said second zipper tape.

4. The adjustment mechanism of claim 1, wherein said at least one control element is coupled between said at least one connection point on said bottom plate and an adjustment point on the item.

5. The adjustment mechanism of claim 1, wherein said at least one control element is coupled between said at least one connection point on said bottom plate and at least two adjustment points on the item.

6. The adjustment mechanism of claim 1, wherein at least one control element is coupled to at least two connection points on said bottom plate of said slide body.

7. The adjustment mechanism of claim 1, wherein at least two control elements are coupled to at least one connection point on said bottom plate of said slide body.

8. The adjustment mechanism of claim 1, wherein movement of said slide body between said zipper tapes moves said connection point on said slide body into contact with said control element, and further movement of said slide body between said zipper tapes moves said control element.

9. An adjustable item including at least one adjustable characteristic controlled by at least one adjustment mechanism comprising:

a slide body including a top plate, a bottom plate, and a first channel and a second channel, said slide body further comprising a first connection point for connecting to a pull element, at least one connection point on said bottom plate for connecting to at least one control element extending through at least one enclosed control element path within said item, and a zipper tape unit comprising a first zipper tape and a second zipper tape, said first zipper tape including a first row of coupling elements, and said second zipper tape comprising a second row of coupling elements, said first zipper tape extending through said first channel of said slide body, and said second zipper tape extending through said second channel of said slide body, wherein said slide body separates said first and second zipper tapes at a leading edge, and joins said zipper tapes at a trailing edge.

10. The adjustable item of claim 9, further comprising an underlayer positioned with said at least one control element between said underlayer and said zipper tape unit.

11. The adjustable item of claim 9, wherein said item comprises at least a first layer and an underlayer, and wherein said control element path extends between said first layer and said underlayer.

12. The adjustable item of claim 9, wherein said at least one control element is coupled between said at least one connection point on said bottom plate and at least one adjustment point on said adjustable item.

13. The adjustable item of claim 9, wherein said control element turns on a turn post proximate said control element path.

14. The adjustable item of claim 9, wherein the adjustable item is selected from the group consisting of: a jacket, a hat, a pair of pants, a shoe, a mitten, a glove, and a bag.

15. The adjustable item of claim 9, wherein said adjustment mechanism of said adjustable item controls a circumference of an opening of said item.

16. The adjustable item of claim 9, wherein said adjustment mechanism of said adjustable item controls a length of a portion of said item.

17. An adjustment mechanism for adjusting an adjustable feature on an item, said adjustment mechanism comprising:

a slide body having a top plate and a bottom plate joined by a connection part defining a first channel and a second channel, said slide body further comprising a first connection point on a top surface of said top plate for connecting to a pull element, at least one connection point on said bottom plate for connecting to at least one control element, and wherein said control element extends between said connection point and an adjustment point on the item, a zipper tape unit comprising a first zipper tape and a second zipper tape, said first zipper tape including a first row of coupling elements, and said second zipper tape comprising a second row of coupling elements, said first zipper tape extending through said first channel of said slide body, and said second zipper tape extending through said second channel of said slide body, and an underlayer positioned with said control element between said underlayer and said zipper tape unit, and wherein said control element extends through an enclosed control element path formed within the item.

wherein said slide body separates said first and second zipper tapes at a leading edge, and joins said zipper tapes at a trailing edge.

18. The adjustment mechanism of claim 17, wherein said first connection point for connecting to a pull element is located on a top surface of said top plate, and said pull element comprises a pull tab.

19. The adjustment mechanism of claim 17, wherein said slide body comprises a locking means.

* * * * *